US008397957B2

(12) United States Patent
Bloom et al.

(10) Patent No.: US 8,397,957 B2
(45) Date of Patent: Mar. 19, 2013

(54) DISPENSING VALVE

(75) Inventors: Kenneth S. Bloom, Bloomdale, OH (US); Philip D. Bourgeois, Perrysburg, OH (US); Darin M. Pugne, Holland, OH (US)

(73) Assignee: Berry Plastics Corporation, Evansville, IN (US)

( * ) Notice: Subject to any disclaimer, the term of this patent is extended or adjusted under 35 U.S.C. 154(b) by 473 days.

(21) Appl. No.: 12/683,030

(22) Filed: Jan. 6, 2010

(65) Prior Publication Data

US 2011/0163134 A1 Jul. 7, 2011

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 37/00*** | (2006.01) |
| ***B65D 47/00*** | (2006.01) |
| ***B67D 3/00*** | (2006.01) |

(52) U.S. Cl. ..... 222/494; 222/212; 222/213; 222/546

(58) Field of Classification Search ..... 222/494, 222/212; 137/859

See application file for complete search history.

(56) References Cited

U.S. PATENT DOCUMENTS

| | | | | |
|---|---|---|---|---|
| 3,822,720 | A | 7/1974 | Souza | |
| 4,699,300 | A * | 10/1987 | Blake | 222/494 |
| 4,749,108 | A | 6/1988 | Dornsbusch et al. | |
| 4,991,745 | A | 2/1991 | Brown | |
| 5,115,950 | A * | 5/1992 | Rohr | 222/490 |
| 5,161,718 | A * | 11/1992 | Gueret | 222/212 |
| 5,205,441 | A * | 4/1993 | Andris | 222/207 |
| 5,271,531 | A | 12/1993 | Rohr et al. | |
| 5,531,363 | A | 7/1996 | Gross et al. | |
| 5,743,443 | A | 4/1998 | Hins | |
| 5,839,614 | A | 11/1998 | Brown et al. | |
| 5,897,033 | A | 4/1999 | Okawa et al. | |
| 5,904,275 | A * | 5/1999 | Suffa | 222/494 |
| 5,924,605 | A | 7/1999 | Baudin et al. | |
| 5,927,566 | A | 7/1999 | Mueller | |
| 6,095,381 | A | 8/2000 | Schwanenberg | |
| 6,095,382 | A * | 8/2000 | Gross | 222/520 |
| 6,230,940 | B1 | 5/2001 | Manning et al. | |
| 6,273,305 | B1 * | 8/2001 | Fioravanti et al. | 222/494 |
| 6,405,901 | B1 | 6/2002 | Schantz et al. | |
| 6,450,375 | B1 | 9/2002 | Hins et al. | |
| 6,543,652 | B1 * | 4/2003 | Kelder et al. | 222/212 |
| 6,672,487 | B1 | 1/2004 | Lohrman | |
| 7,108,361 | B2 * | 9/2006 | Kitabatake et al. | 347/86 |

(Continued)

FOREIGN PATENT DOCUMENTS

| | | | |
|---|---|---|---|
| DE | 4403080 | A1 | 8/1995 |
| DE | 19510007 | A1 | 10/1995 |

(Continued)

*Primary Examiner* — Kevin P Shaver
*Assistant Examiner* — Vishal Pancholi
(74) *Attorney, Agent, or Firm* — Barnes & Thornburg LLP

(57) ABSTRACT

A dispensing valve includes a resiliently flexible mounting portion, a resiliently flexible opening portion disposed radially inwardly of the mounting portion, and a resiliently flexible isolating portion disposed radially between and coupled to the mounting and opening portions. The isolating portion extends both radially outwardly and axially to form a first radial space between the opening and isolating portions, and is spaced radially inwardly of the mounting portion to form a second radial space between the mounting and isolating portions. The opening portion may include one or more slits.

58 Claims, 8 Drawing Sheets

U.S. PATENT DOCUMENTS

| | | | | |
|---|---|---|---|---|
| 7,128,245 | B2 | 10/2006 | Lee | |
| 7,255,250 | B2 * | 8/2007 | Pugne | 222/556 |
| 7,503,469 | B2 | 3/2009 | Bloom et al. | |
| 2004/0178230 | A1 * | 9/2004 | Feierabend | 222/494 |
| 2005/0269373 | A1 * | 12/2005 | Gaiser et al. | 222/494 |
| 2005/0279781 | A1 | 12/2005 | Pugne | |
| 2006/0201976 | A1 | 9/2006 | Bloom et al. | |
| 2006/0249545 | A1 * | 11/2006 | Ramsey | 222/494 |
| 2007/0251079 | A1 * | 11/2007 | Pugne | 29/428 |
| 2008/0237278 | A1 | 10/2008 | Gaus et al. | |
| 2008/0314860 | A1 * | 12/2008 | Pugne et al. | 215/330 |
| 2009/0188950 | A1 | 7/2009 | Gaus et al. | |

FOREIGN PATENT DOCUMENTS

| | | | |
|---|---|---|---|
| DE | 4440211 | C1 | 2/1996 |
| DE | 29706 456 | U1 | 8/1998 |
| GB | 2324297 | A | 10/1998 |
| JP | 10264954 | | 10/1998 |
| WO | WO 95/21098 | | 8/1995 |
| WO | WO 99/10247 | | 3/1999 |
| WO | WO 2004/099024 | | 11/2004 |

* cited by examiner

DISPENSING VALVE

The present disclosure is directed to dispensing valves, to dispensing closures that include such valves, and to packages that include such closures.

BACKGROUND AND OBJECTS OF THE DISCLOSURE

U.S. Pat. No. 6,672,487 discloses a dispensing package for fluid products. A container has a body for holding a product to be dispensed and has a finish extending from the body with an open mouth. A closure base includes a ledge with a skirt externally secured to the finish and a cylindrical wall extending from the ledge coaxially with the mouth. A collar has a deck with a central opening aligned with the mouth, a first cylindrical wall surrounding the opening and extending away from the mouth, and a second cylindrical wall externally surrounding and secured to the cylindrical wall on the base. A lid is integrally connected to the collar or the base by at least one hinge. A dispensing valve of flexible resilient elastomeric construction has a peripheral portion captured between the collar deck and the base cylindrical wall for securing the valve in position and simultaneously functioning as a seal between the base and the collar. The valve also has an intermediate portion underlying the collar deck, and an annular wall portion extending from an inner end of the intermediate portion radially inwardly adjacent to an inner surface of the first cylindrical collar wall. The valve further has an inner portion extending radially inwardly from the annular wall portion, and at least one dispensing slit in the inner portion.

U.S. Pat. No. 7,503,469 discloses a dispensing valve that includes an annular ring of relatively rigid molded plastic construction, and a flexible resilient valve element integrally molded onto the ring, and the ring and the valve element have at least one mechanical interlock to secure the valve element to the ring as the valve element is molded onto the ring. The mechanical interlock includes openings in an inner periphery of the annular ring and portions of the valve element molded into the openings. The inner periphery of the ring includes an annular ledge, and the openings are through-openings disposed in an angularly spaced array around the ledge. Each of the openings includes an enlarged portion opening at one axially facing surface of the ledge and an ensmalled portion aligned with the enlarged portion and opening to a second axially facing surface of the ledge.

One or more general objects of the present disclosure, in accordance with one aspect of the disclosure, include providing a dispensing valve that is made of one piece and is not retained to a closure by a separate rigid retainer collar or mounting ring, may be recycled with a closure, may include a mounting portion and an opening portion flexibly coupled to the mounting portion by an isolating portion, and/or may have a vacuum break to reduce occurrences of valves sticking to one another and/or to material handling equipment during production.

The present disclosure embodies a number of aspects that can be implemented separately from or in combination with each other.

A dispensing valve in accordance with one aspect of the disclosure includes a resiliently flexible mounting portion, a resiliently flexible opening portion disposed radially inwardly of the mounting portion, and a resiliently flexible isolating portion disposed radially between and coupled to the mounting and opening portions. The isolating portion extends both radially outwardly and axially to form a first radial space between the opening and isolating portions, and is spaced radially inwardly of the mounting portion to form a second radial space between the mounting and isolating portions. Preferably, the opening portion may include one or more slits.

In accordance with another aspect of the disclosure, a dispensing valve includes a one-piece valve body of integrally formed plastic construction and of uniform plastic composition. The valve body includes an radially outward annular portion including a radially inward leg and a radially outward leg configured for coupling to a valve mounting structure that at least radially outwardly surrounds the outward leg. The annular portion preferably has a cross section of at least one of the following shapes: W-shape, X-shape, M-shape, V-shape, inverted V-shape, inverted U-shape, U-shape, or block U-shaped. The valve body also includes a circular inward valve portion integrally and flexibly coupled to a free end of the inward leg of the annular portion, the inward valve portion having at least one slit. The cross section of the annular portion at least partially isolating the inward valve portion from stresses imparted to the dispensing valve.

In accordance with a further aspect of the disclosure, a dispensing assembly includes a dispensing structure having a dispensing passage and an annular wall, and a dispensing valve carried within the annular wall of the dispensing structure and in communication with the dispensing passage. The dispensing valve consists of a one-piece valve body of integrally molded plastic construction and of uniform plastic composition. The valve body includes an radially outward annular portion including a radially inward leg and a radially outward leg configured for coupling to a valve mounting structure that at least radially outwardly surrounds the outward leg. The annular portion preferably has a cross section of at least one of the following shapes: W-shape, X-shape, M-shape, V-shape, inverted V-shape, inverted U-shape, U-shape, or block U-shaped. The valve body also includes a circular inward valve portion integrally and flexibly coupled to a free end of the inward leg of the annular portion, the inward valve portion having at least one slit. The cross section of the annular portion at least partially isolating the inward valve portion from stresses imparted to the dispensing valve.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION

Figure 1:
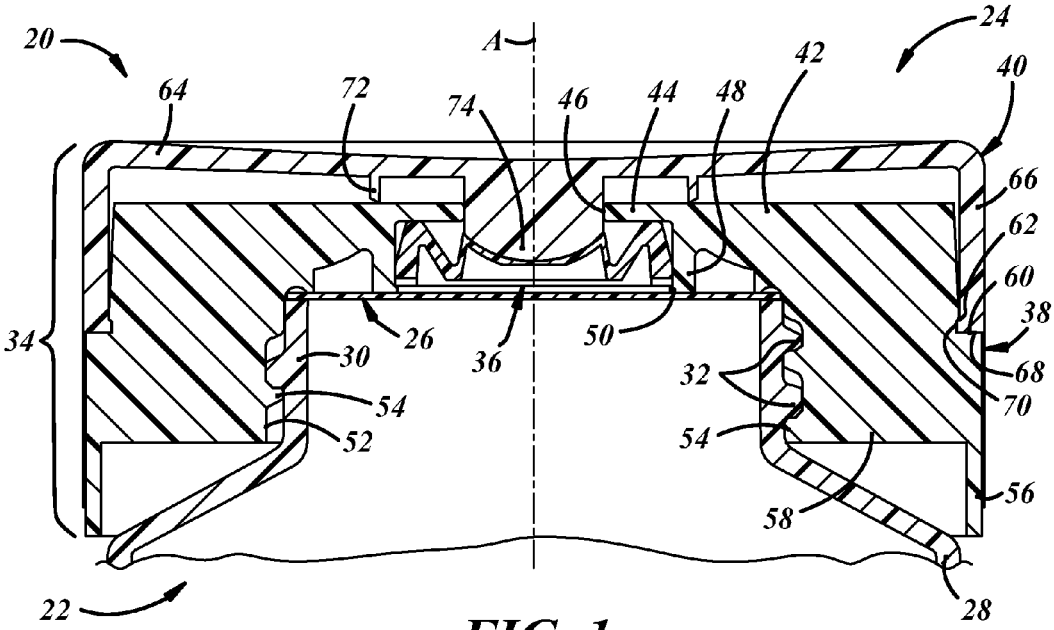
FIG. 1 is a fragmentary sectional view diametrically bisecting a package of an exemplary embodiment of the present disclosure.

FIG. 1 illustrates a dispensing package 20 in accordance with one presently preferred embodiment of the disclosure as comprising a container 22 and a dispensing assembly 24 secured to the container 22. The package 20 may be used to contain and dispense any suitable product, for example, fluid products such as beverages, body lotions, and food condiments, for instance, ketchup, mustard, mayonnaise, or the like. Also, a liner 26 may be disposed between the container 22 and the dispensing assembly 24 in any suitable manner. The package 20 extends along a longitudinal axis A.

The container 22 may be of one-piece integrally molded plastic construction and may be composed of any suitable container material compatible with the product to be contained. The container 22 has a flexible resilient body 28 for holding product to be dispensed, and for being squeezed from its state of rest to dispense product and being released from its squeezed state to automatically return to its state of rest to withdraw residual product back into the container 22. A cylindrical neck finish 30 extends from the body 28 and surrounds and establishes a container mouth. The neck finish 30 may include one or more engagement elements, for example, external beads or threads 32 for securing the dispensing assembly 24 to the container 22. As used herein, the term threads includes one or more threads or thread segments that may be continuous or discontinuous and may or may not extend around the entire circumference of the neck finish 30.

As shown in FIG. 1, the dispensing assembly 24 may be a two-piece assembly that includes a dispensing structure, for example a shell 34, to which a dispensing valve 36 is secured. Although illustrated as a closure shell 34, the dispensing structure may instead include a portion of a container.

In the illustrated embodiment, the shell 34 may be of one-piece integrally molded plastic construction, and may be composed of any suitable material compatible with the product to be contained and dispensed. For example, the shell 34 may be composed of polypropylene, polyethylene, polypropylene copolymer, polyethylene copolymer, or any other suitable thermoplastic or thermoplastic-copolymer.

The valve 36 may be of one-piece integrally molded plastic construction, and may be composed of any suitable elastomeric material compatible with the product to be contained and dispensed. For example, the valve 36 may be composed of an elastomeric material that is recyclable with the material of the shell 34. In another example, the valve 36 may be composed of an elastomeric material that is melt compatible or melt processable with the shell 34.

In one preferred embodiment, the material density of the valve 36 is less than 1.0 gm/cc. In another preferred embodiment, the material density of the valve 36 is less than 0.98 gm/cc. In a further preferred embodiment, the material density of the valve 36 is less than 0.92 gm/cc. For example, in a post-consumer recycling stream of a package including the dispensing assembly 24 assembled on a polyethylene terephthalate (PET) container, the package is ground up and grindings are disposed in water in a float/sink separating tank. The PET container grindings sink because the PET density is greater than 1.0 gm/cc, whereas the shell and valve grindings float because their material densities are less than 1.0 gm/cc. Accordingly, the shell and valve grindings can be skimmed off and separated from the container material. Such an outcome is in contrast to that experienced with current dispensing closures known in the art and marketplace, wherein silicone rubber vulcanizates or elastomer materials used to construct the valve typically have densities greater than 1.0 gm/cc and, thus, may become comingled with the PET container material during the post-consumer recycling operation and contaminate the PET material during further recycling operations.

Although the valve 36 is preferably composed of a thermoplastic or a thermoplastic elastomer, the valve 36 may be composed of any suitable polymeric material. For example, according to a less preferred embodiment, the valve 36 may be composed of a thermoset polymer, for example, silicone rubber vulcanizates. According to another less preferred embodiment, the valve 36 may have a density higher than 1.0 gm/cc.

The shell 34 includes a base 38 to which a lid 40 may be pivotally secured by a hinge (not shown). The hinge may be a snap hinge of the type illustrated in U.S. Pat. Nos. 5,794,308 and 6,041,477. However, the disclosure is by no means limited to hinges of this type, and other hinge arrangements can be employed.

Still referring to FIG. 1, the base 38 includes a deck 42 and an opening wall 44 of the deck 42 may be of any suitable shape. For example, the opening wall 44 may extend substantially perpendicularly to the axis A as shown, or may be domed, for instance, of conical construction. As used herein, terms like substantially and generally may include manufacturing tolerances, variations for good molding practices, and/or the like. A dispensing passage or opening 46 is positioned in the deck opening wall 44, and is preferably centrally positioned. A valve mounting structure, for instance and annular wall 48, extends axially from an undersurface of the deck opening wall 44 surrounding and coaxial with the dispensing opening 46. The valve 36 may be carried within the annular wall 48 and in communication with the dispensing passage or opening 46. A radially inwardly extending internal bead 50 may be provided on the annular wall 48, and may be either circumferentially continuous or segmented.

Also, the base 38 includes an internal skirt 52 with internal attachment means, such as threads or thread segments 54, for securing the closure shell 34 to the container neck finish 30, and an external skirt 56 that axially extends from a radial periphery of the base 38. The external skirt 56 may be of a geometry to match the geometry of the associated container 22, such as cylindrical in the embodiment illustrated in the drawings. A circumferential array of radially and axially extending ribs 58 may interconnect the skirts 52, 56 for strengthening and rigidifying the closure shell base 38. Single wall closure shells also can be employed. A radially peripheral portion of the deck 42 also includes a ledge 60 that is axially recessed with respect to opening wall 44. The ledge 60 extends entirely around the opening wall 44 in a plane that preferably is perpendicular to the axis A. A radially outwardly extending circumferential bead 62 may extend at least part way around the deck 42 axially adjacent to but spaced from the ledge 60.

With reference to FIG. 1, the lid 40 includes a base wall 64 and a radially peripheral skirt 66. An edge 68 of the skirt 66 remote from the base wall 64 preferably lies in a plane, and is adapted for edge engagement with the ledge 60 on the base 38 in the closed position of the lid 40. An internal bead 70 preferably extends at least part way around the lid skirt 66 for snap-receipt over the bead 62 to hold the lid 40 in the closed position. An annular bead 72 on the lid base wall 64 contacts an upper surface of the deck 42 of the base 38 in the closed position of the lid 40. As used herein, directional words such as "upper" and "lower" are used by way of description and not limitation with respect to the upright orientation of the closure and package illustrated in FIG. 1. A plug 74 may be disposed radially within the bead 72 and may be disposed adjacent to the valve 36 in the closed position of the lid 40. The plug 74 may be a solid cylinder, crossed walls, or the like. The plug 74 may contact the valve 36 to help prevent the valve 36 from opening when the lid 40 is closed, thereby preventing undesired leakage of product from within the package 20. In one embodiment, the lid 40 need not include the plug 74.

Figure 2:
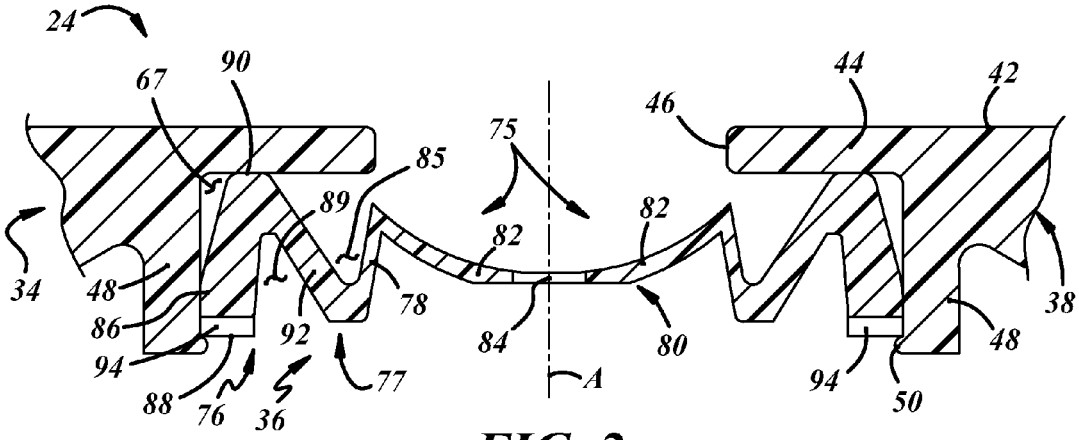
FIG. 2 is a fragmentary sectional view on an enlarged scale of a dispensing assembly of the package illustrated in FIG. 1.

Referring now to FIG. 2, the valve 36 includes a resiliently flexible opening portion 75 through which product may flow, a resiliently flexible attachment or mounting portion 76 by which the valve 36 may be at least partially mounted to the closure shell base 38, and a resiliently flexible isolating portion 77 coupled between the opening and mounting portions 75, 76. The isolating portion 77 at least partially isolates the opening portion 75 from the mounting portion 76 to ensure good working operation of the opening portion 75. For example, the isolating portion 77 may reduce the influence of side pressure on the opening and sealing performance of the opening portion 75.

The opening portion 75 is configured to open and close to allow and block flow of product therethrough. The opening portion 75 includes a radially inward annular wall 78, and a web 80 that extends radially inwardly of the annular wall 78. As used herein, directional words such as "axial," "radial" and "lateral" are taken with respect to a longitudinal axis of a package, which is preferably coaxial with the axis of the container neck finish. Likewise, directional words such as "inward" and "outward" are taken with respect to the package interior. The web 80 may be a circular or disc-like element that extends transversely across the axis A and includes one or more openings through which fluid product may flow.

For example, the web 80 may include two or more valve petals 82 that may be established by two or more slits 84. Because FIG. 2 is a sectional view, only one slit 84 and two petals 82 can be seen, but any suitable quantity of the petals 82 and slits 84 may be provided. In one example, a single straight slit may be provided to establish two straight petals 82. In another example, an omega-shaped slit may be provided to establish a flap. In other examples, the web 80 may include one or more other types of openings instead of or in addition to the slit(s) 84, for instance, one or more self-sealing apertures, flaps, or the like. The web 80 may be dish-shaped or concave-shaped to extend both axially and radially inwardly from an axially outward end of the wall 78. However, the web 80 may be of any suitable shape and configuration. As used herein, the terminology transverse includes being disposed at any angle with respect to an axis including, but not limited to, a perpendicular orientation. The wall 78 extends radially inwardly from the web 80 and may also extend radially outwardly from the web 80 so as to have a conical shape.

As shown in FIG. 2, the mounting portion 76 is configured to couple the valve 36 to the annular wall 48 of the closure shell base 38. The mounting portion 76 may be annular in shape and disposed at a radially outward periphery of the valve 36. In this embodiment, the mounting portion 76 includes an annular leg or wall 86 that extends from an axially inward surface 88 of the valve 36 to an axially outward surface 90 of the valve 36 in a radially inward direction so as to have a conical shape. Accordingly, a radial space 67 may be established between the axially outward end of the mounting portion 76 and the annular wall 48 of the closure shell base 38. Also, the axially outward surface 90 may be in sealing contact with a corresponding axially inward surface of the closure shell base 38.

The isolating portion 77 is configured to flexibly couple the opening portion 75 to the mounting portion 76 so as to at least partially isolate the opening portion 75 of the valve from the mounting portion 76. Accordingly, any distortion or misalignment of, or pressure on, the mounting portion 76 will have little to no influence on the ability of the petals 82 of the opening portion 75 to properly or correctly seat to one another to seal the valve 36 closed. Also, the isolating portion 77 may include an annular leg or wall 92 that is radially inward with respect to the radially outward annular wall 86, and radially intermediate with respect to the annular wall and the radially inward annular wall 78. The radially intermediate annular wall 92 may include an axially inward end coupled to the radially inward annular wall 78. In particular, the axially inward end of the wall 92 may be coupled directly to an axially inward end of the wall 78. The radially intermediate annular wall 92 may be cantilevered from the radially inward annular wall 78.

With reference to FIG. 2, the intermediate annular wall 92 may extend axially outwardly and terminate in an axially outward end that may be coupled to the mounting portion 76. More specifically, the axially outward end of the intermediate annular wall 92 may be coupled directly to an axially outward end of the mounting portion 76. The intermediate annular wall 92 also may extend radially outwardly, wherein the intermediate annular wall 92 and the mounting portion 76 form an inverted V-shaped annular portion that is disposed radially outwardly of the opening portion 75. Accordingly, a wedge-shaped radial space 89 may be established between the mounting portion 76 and the intermediate annular wall 92. Also, the inward and intermediate annular walls 78, 92 also may form a V-shaped structure. Accordingly, a wedge-shaped radial space 85 may be established between the annular walls 78, 92. The radially outward annular wall 86 may be cantilevered from the radially intermediate annular wall 92.

The valve 36 additionally may include one or more vacuum breaks 94 in or on an axially inward most surface of the valve 36. In this embodiment, the axially inward most surface of the valve 36 is the axially inward surface 88 of the mounting portion 76. The vacuum break(s) 94 may include one or more slots, channels, or other reliefs molded, cut, or otherwise provided in the valve 36. The vacuum break(s) 94 may also or instead include one or more ribs, ridges, bumps, or other projections molded or otherwise provided on the valve 36. The vacuum break(s) may be circumferentially spaced and radially extending. The vacuum break(s) 94 may reduce occurrences of two valves 36 from sticking to one another and/or to material handling equipment during production of the dispensing assembly 24.

Still referring to FIG. 2, the dispensing assembly 24 may be produced in any suitable manner. The shell 34 may be manufactured by injection or compression molding, or in any other suitable fashion. Also, the valve 36 may be injection or compression molded and then cut or formed in a downstream operation to establish the slit(s) 84, or may be manufactured in any other suitable manner. The isolating portion 77 may assist in maintaining good recombination or seating between the valve petals 82 during and after slitting of the web 80 to establish the slit(s) 84.

Furthermore, the valve 36 may be assembled to the closure shell 34 in any suitable manner. For example, the closure shell 34 may be held by a die, holder, or other tool (not shown) in any suitable fashion, and the valve 36 may be inserted within the annular wall 48 by another tool (not shown) from an axially inward side of the closure shell base 38 and retained thereto by the bead 50, by friction, by crimping, and/or any other suitable means. In another example, the valve 36 may be held by a die, holder, or other tool (not shown) in any suitable fashion, and the closure shell 34 may be placed over the valve 36 so that the annular wall 48 envelops the valve 36 and is retained thereto by the bead 50 and/or by friction.

In any case, and still referring to FIG. 2, the tool that supports the valve 36 may be configured to contact a suitable portion of the axially inward surface of the valve 36 to allow the valve 36 to be assembled relative to the closure shell 34 to maintain the petals 82 in good sealing contact and/or to prevent the petals 82 from becoming distorted and unseated or unsealed with respect to one another. For example, the tool may support the axial inward surface of the valve 36 in a radial direction from about the axial inward ends of the annular walls 78, 92, and in at least a portion of the radial space 89. The tool may further support the valve 36 by extending entirely radially across the radial space 89 and up to the axially inward surface 88 of the outward peripheral portion 86. The tool additionally may support the valve 36 by further extending radially outward over at least a portion of the axially inward surface 88 of the outward peripheral portion 86. Therefore, the valve 36 may be supported by the tool on surfaces of the axially inward side of the valve 36 that are radially outboard of the opening portion 275.

When a valve is assembled to a closure shell, particularly under a compression or interference fit, the valve design of the present disclosure reduces or prevents valve distortion like valve petal puckering or unseating by absorbing forces that would otherwise cause such distortion. More specifically, the flexible coupling provided by the isolating portion 77 between the opening portion 75 and the mounting portion 76 is provided to absorb such forces so that the petals 82 will properly seat to one another to seal the valve 36 closed.

Finally, and with reference to FIG. 1, the liner 26 may be initially secured to the closure shell base 38 and made part of the assembly 24. In any case, the assembly 24 may be delivered for use in a fluid product packaging environment.

In one example of use, and still referring to FIG. 1, the container 22 is filled with product to be dispensed with the dispensing assembly 24 removed. The dispensing assembly 24 is then secured to the container neck finish 30. The liner 26 may have been placed within the closure skirt 52 and carried by the closure shell base 38 prior to securement of the dispensing assembly 24 to the container neck finish 30. In such an embodiment, the liner 26 may be an induction seal liner, which may comprise a layered construction, having an underlayer of plastic and a layer of metal foil, for example. The metal foil may be heated by induction to melt at least peripheral portions of the plastic layer to secure the liner 26 to the end of the container neck finish 30 so as to seal the product-containing container 22.

When the package 20 is ready for dispensing of the product by a user, the dispensing assembly 24 is removed by the user and the liner 26—having been previously induction sealed to the container neck finish 30—is cut or peeled away from the container neck finish 30. The dispensing assembly 24 is then resecured to the container neck finish 30. With the closure lid 40 pivoted to an open position (not shown), the package 20 may be shaken to prepare the product for dispensing. Shaking of the package 20 does not result in spillage or ejection of product because of the valve 36. The user may squeeze and thereby pressurize the container body 28 to move product through the valve 36.

Under such pressure, and with reference to FIG. 2, the valve 36 may resiliently flex to allow product to move therethrough. For example, at least a portion of the wall 78 may resiliently flex radially outwardly into the radial space 85. In another example, at least a portion of the intermediate annular wall 92 may resiliently flex.

Referring to FIG. 1, when the desired amount of product has been dispensed, the container body 28 may be released. The vacuum produced by the container body 28 returning to its original shape may cause some product to be withdrawn or pulled back through the valve 36 for a clean shut-off of product and a clean dispensing opening 46.

Also, with reference to FIG. 2, one or more portions of the valve 36 may return to a rest position. For example, one or more of the walls 78 and/or 92 may resiliently return to rest positions.

When a user releases a container body, the valve design of the present disclosure reduces or prevents valve distortion like valve petal puckering or unseating by absorbing residual radial pressure that would otherwise cause such distortion. More specifically, such pressure can be absorbed by the flexible coupling provided by the isolating portion 77 between the opening portion 75 and the mounting portion 76. Therefore, the petals 82 will properly seal to one another to close the valve 36.

Finally, with reference to FIG. 1, the lid 40 may be closed and snapped over the closure shell base 38. Accordingly, with embodiments that include the plug 74, the plug 74 may contact the opening portion 75 of the valve 36 to prevent dispensing of product.

FIGS. 3 through 18B illustrate several other exemplary embodiments of the present disclosure. These embodiments are similar in many respects to one another and to the embodiment of FIGS. 1 and 2, and like numerals between the embodiments designate like or corresponding elements throughout the several views of the drawing figures. Additionally, the descriptions of the embodiments are incorporated by reference into one another and the common subject matter generally may not be repeated.

Figure 3:
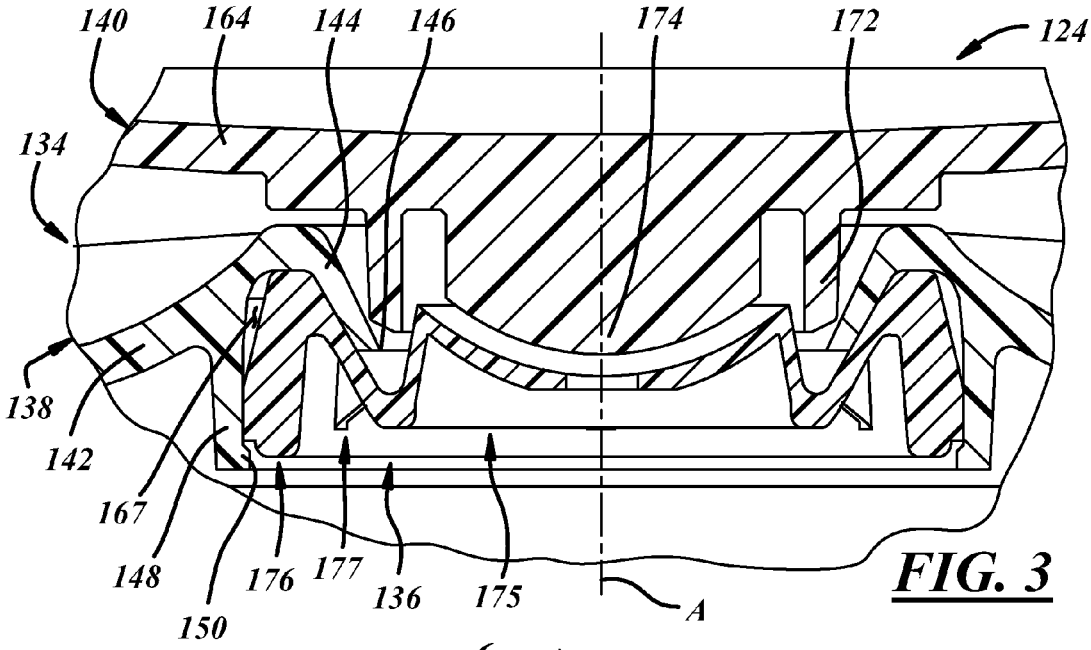
FIG. 3 is a fragmentary sectional view diametrically bisecting a dispensing assembly of another exemplary embodiment of the present disclosure.

FIG. 3 illustrates a dispensing assembly 124 in accordance with another presently preferred embodiment of the disclosure. The assembly 124 extends along a longitudinal axis A, and may be a two-piece assembly that includes a shell 134 to which a dispensing valve 136 is secured.

The shell 134 includes a base 138 to which a lid 140 may be pivotally secured by a hinge (not shown). The base 138 includes a deck 142 and an opening wall 144 of the deck 142. The deck 142 may be of domed, cylindrical, or conical construction. In particular, the deck 142 may be incurvately conical. Also, the opening wall 144 of the deck 142 may extend axially and radially inwardly toward a dispensing opening 146. For example, the opening wall 144 may be of conical construction. An annular wall 148 extends axially from an undersurface of the deck opening wall 144 surrounding and coaxial with the dispensing opening 146. A radially inwardly extending internal bead 150 may be provided on the annular wall 148. The lid 140 includes a base wall 164, an annular bead 172 extending from the base wall 164 and disposed between the opening wall 144 and the valve 136, and a plug 174 disposed radially within the bead 172 and disposed adjacent to the valve 136 in a closed position of the lid 140.

Figure 4:
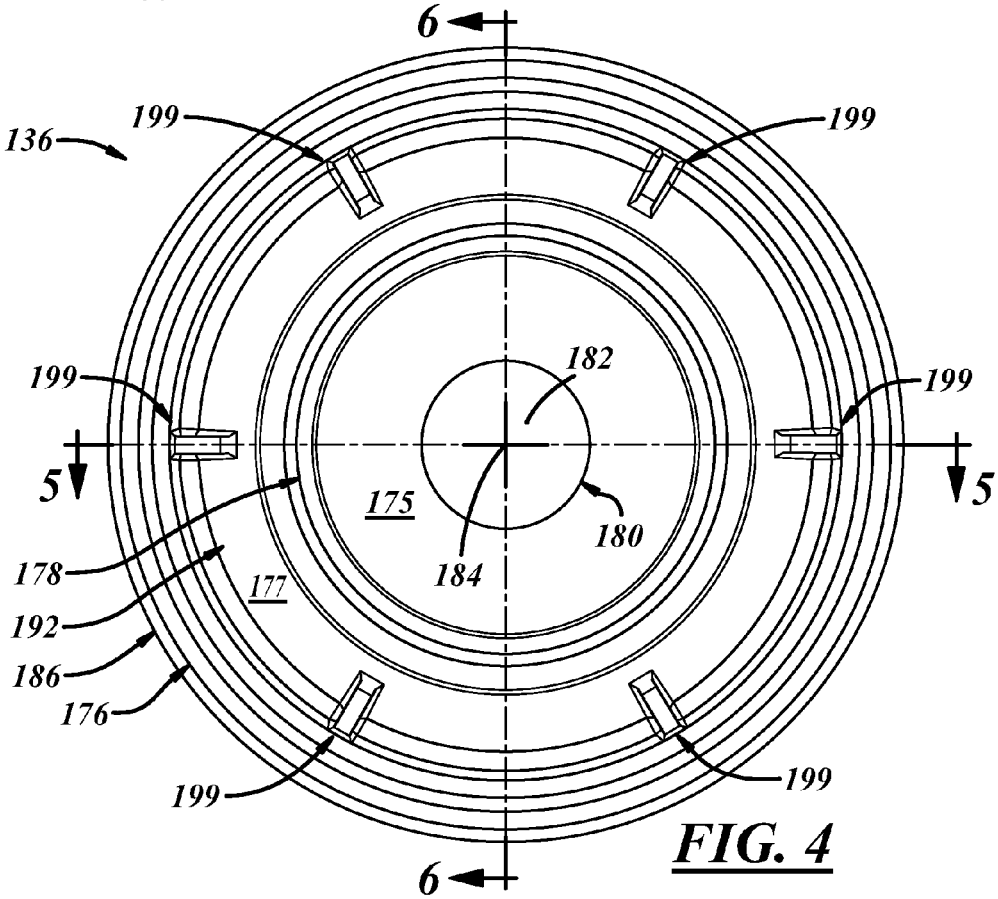
FIG. 4 is a bottom view of a dispensing valve of the assembly of FIG. 3.
Figure 5:
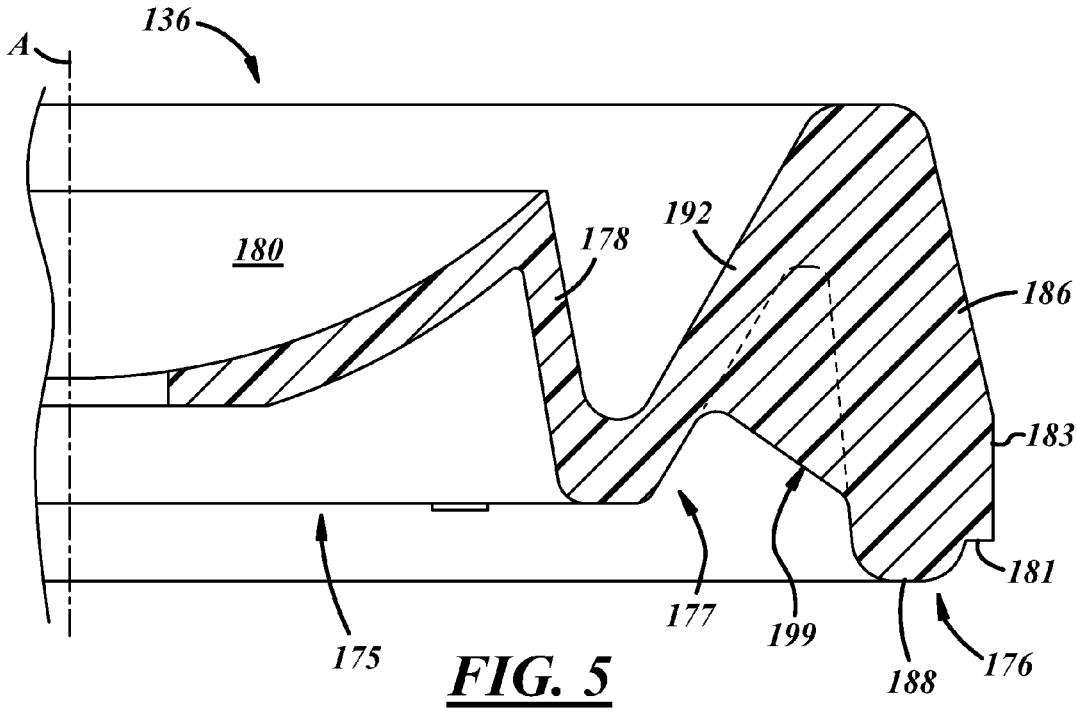
FIG. 5 is a fragmentary sectional view, taken along line 5-5 of the valve of FIG. 4.
Figure 6:
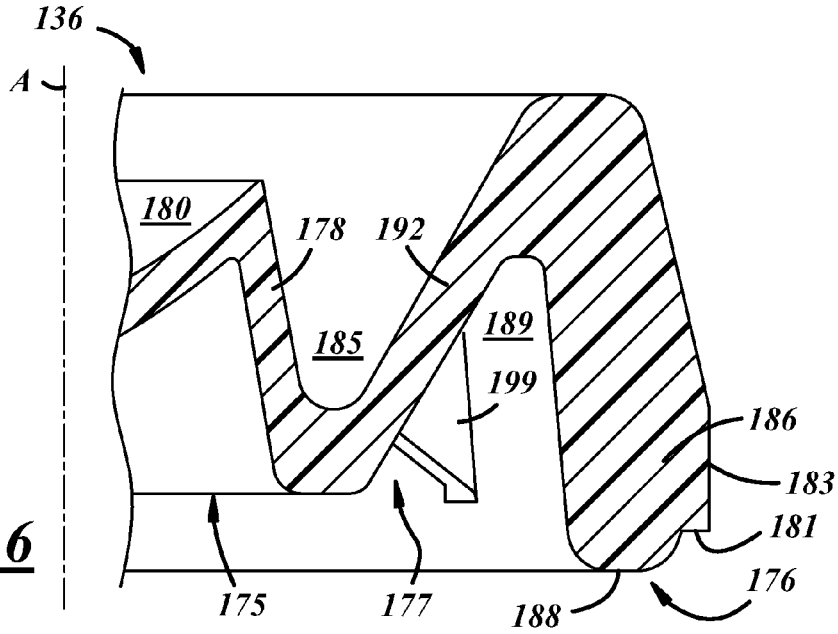
FIG. 6 is a fragmentary sectional view, taken along line 6-6 of the valve of FIG. 4.

Referring to FIGS. 4-6, the valve 136 generally includes a resiliently flexible opening portion 175 that may have one or more slits 184 (FIG. 4) through which product may flow, a resiliently flexible mounting portion 176 by which the valve 136 may be at least partially mounted to the closure shell base 138, and a resiliently flexible isolating portion 177 by which the opening portion 175 is at least partially isolated from the mounting portion 176 to ensure good working operation of the opening portion 175. Also, the opening portion 175 includes a radially inward annular wall 178, and a web 180 that may include a plurality of petals 182 (FIG. 4) established by crossed slits 184 (FIG. 4). Moreover, the isolating portion 177 includes a radially intermediate annular wall 192 that extends at an angle of about 0-60 degrees from the axis A, and a space 185 (FIG. 6) is established between the walls 178, 192. Further, the mounting portion 176 includes a radially outward annular wall 186 that extends at a suitable angle from the axis A (for example any angle in a range extending plus or minus sixty degrees from the axis A), and a space 189 (FIG. 6) is established between the walls 186, 192. Thus, in general, the valve 136 is similar to the valve 36 of FIGS. 1-2, with a couple of exceptions.

First, with reference to FIGS. 5 and 6, the wall 186 of the mounting portion 176 includes an axially inward surface 188, a cylindrical surface 183 adjacent the surface 188, and a step 181 between the surfaces 183, 188 for positive retention of the valve 136 to the annular wall 148 of the closure shell base 138 (FIG. 3). The wall 186 may be radiused radially inward and outward of the axially inward surface 188, and the wall 186 may have a conical outer profile that extends axially outwardly from the cylindrical surface 183.

Second, with reference to FIGS. 4-6, the isolating portion 177 also includes a plurality of ribs 199 extending between the mounting and isolating portions 176, 177. More specifically, the ribs 199 may extend between the radially outer and intermediate walls 186, 192. Thus, the ribs 199 extend at least partially into the space 189 (FIG. 6) between the mounting and isolation portions 176, 177. The ribs 199 may provide additional resiliency to the valve 136.

Figure 7:
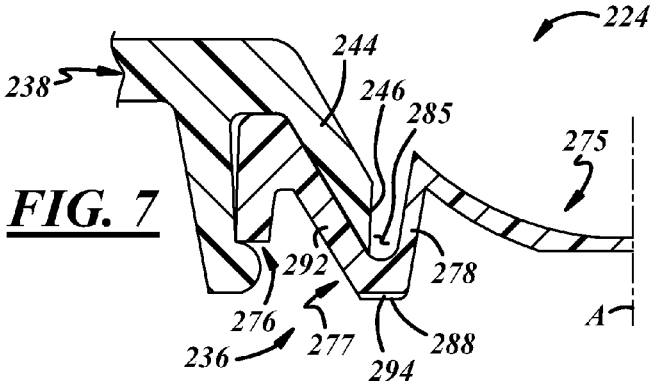
FIG. 7 is a fragmentary sectional view of a dispensing assembly in accordance with a second exemplary embodiment.

Referring to FIG. 7, a dispensing assembly 224 includes a valve 236 including an opening portion 275, a mounting portion 276, and an isolating portion 277. This embodiment is similar to the embodiment of FIG. 2, with a few exceptions. In this embodiment, a closure shell base 238 includes a deck opening wall 244 that corresponds to a radially intermediate annular wall 292 of the valve 236. For example, the deck opening wall 244 may extend axially and radially inwardly toward a dispensing opening 246 to form a conical shape in correspondence with the intermediate annular wall 292 of the valve 236. Accordingly, a radial space 285 may be established between the intermediate annular wall 292 and/or the deck opening wall 244 on the one hand, and a radially inward annular wall 278 of the valve opening portion 275 on the other. Also in this embodiment, the valve 236 may include one or more vacuum breaks 294 in an axially inward most surface 288 of the valve 236, wherein the axially inward most surface 288 is provided in one or both of axially inward ends of the wall(s) 278, 292.

Figure 8:
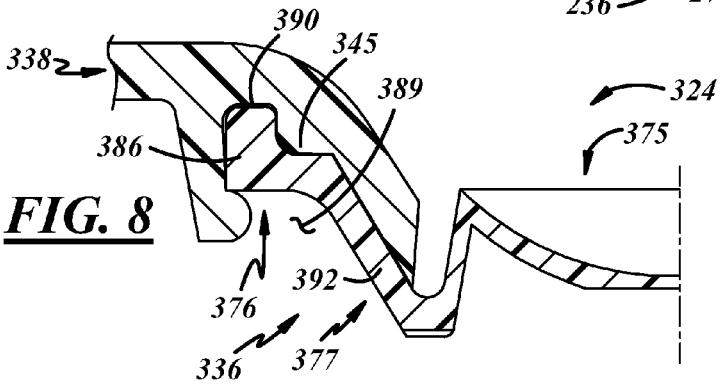
FIG. 8 is a fragmentary sectional view of a dispensing assembly in accordance with a third exemplary embodiment.

Referring to FIG. 8, a dispensing assembly 324 includes a valve 336 including an opening portion 375, a mounting portion 376, and an isolating portion 377. This embodiment is similar to the embodiment of FIG. 7, with a few exceptions. In this embodiment, a closure shell base 338 includes a valve retaining projection 345 that may extend axially inwardly and radially outwardly to further retain the valve 336 to the shell base 338. Also, the mounting portion 376 includes a radially outward wall 386 that may be L-shaped and extends from an outer end of a radially intermediate annular wall 392 to an axially outward surface 390 of the valve 336. Accordingly, an open radial space 389 may be established between the mounting portion 376 and the intermediate annular wall 392.

Figure 9:
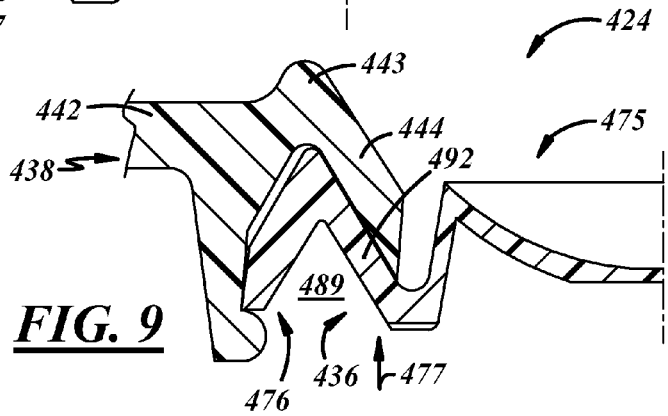
FIG. 9 is a fragmentary sectional view of a dispensing assembly in accordance with a fourth exemplary embodiment.

Referring to FIG. 9, a dispensing assembly 424 includes a valve 436 including an opening portion 475, a mounting portion 476, and an isolating portion 477. This embodiment is similar to the embodiment of FIG. 2, with a few exceptions. In this embodiment, a closure shell base 438 includes an axially outward extending annular bead 443 between a portion of a deck 442 and an axially inwardly conical opening wall 444 of the deck 442. Also, a mounting portion 476 is disposed at such an angle so as to form, between the mounting portion 476 and a radially intermediate annular wall 492, a radial space 489 in a general shape of a triangle.

Figure 10:
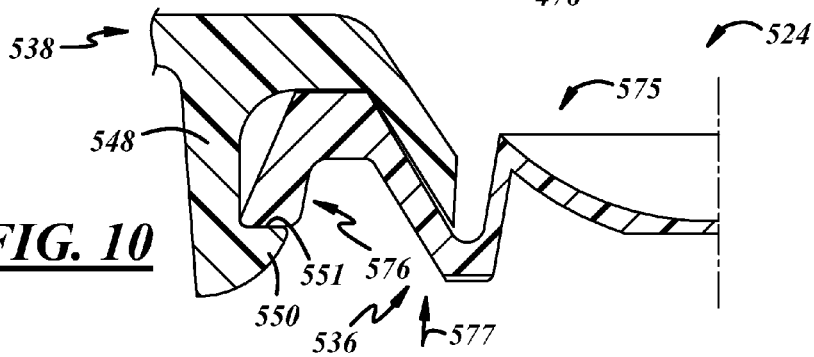
FIG. 10 is a fragmentary sectional view of a dispensing assembly in accordance with a fifth exemplary embodiment.

Referring to FIG. 10, a dispensing assembly 524 includes a valve 536 including an opening portion 575, a mounting portion 576, and an isolating portion 577. This embodiment is similar to the embodiment of FIG. 7, with at least one exception. In this embodiment, a closure shell base 538 includes an axially inwardly extending annular wall 548 having an annular bead 550 with a flat retention surface 551 for positive retention of the mounting portion 576.

Figure 11:
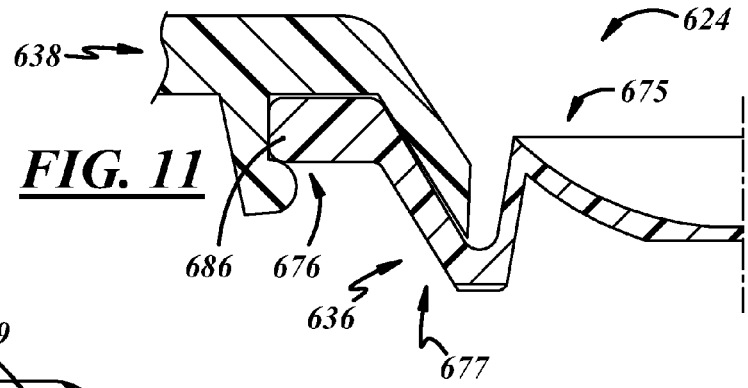
FIG. 11 is a fragmentary sectional view of a dispensing assembly in accordance with a sixth exemplary embodiment.

Referring to FIG. 11, a dispensing assembly 624 includes a valve 636 including an opening portion 675, a mounting portion 676, and an isolating portion 677. This embodiment is similar to the embodiment of FIG. 8, with a couple of exceptions. A closure shell base 638 does not include the valve retaining projection 345 of FIG. 8, and a mounting portion 676 of a valve 636 is substantially rectangular in shape. For example, a radially outward wall 686 is greater in radial width than in axial height.

Figure 12:
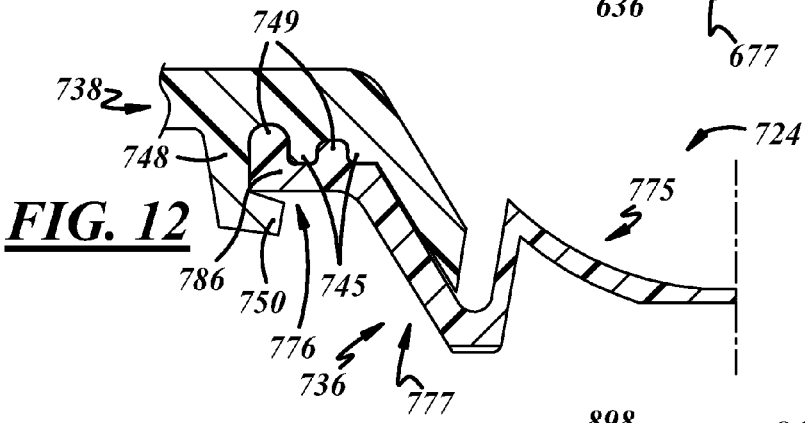
FIG. 12 is a fragmentary sectional view of a dispensing assembly in accordance with a seventh exemplary embodiment.

Referring to FIG. 12, a dispensing assembly 724 includes a valve 736 including an opening portion 775, a mounting portion 776, and an isolating portion 777. This embodiment is similar to the dispensing assembly 624 of FIG. 11, with a couple of exceptions. An annular wall 748 of a closure shell base 738 is crimped over a mounting portion 776 of the valve 736 to form a crimped portion 750 instead of a molded bead for positive retention of the valve 736. And the mounting portion 776 includes annular attachment rings 749 interdigitated with corresponding annular attachment rings 745 of the closure shell base 738 for additional positive retention of the valve 736.

Figure 13A:
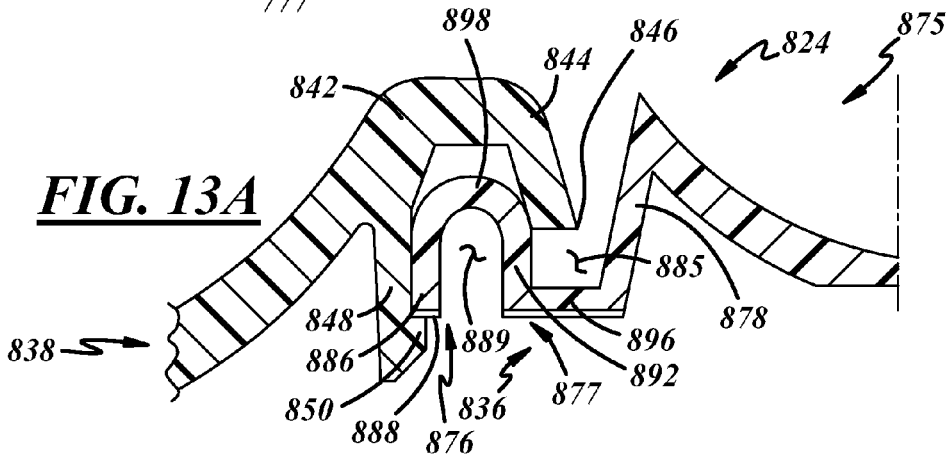
FIG. 13A is a fragmentary sectional view of a dispensing assembly in accordance with an eighth exemplary embodiment.

Referring to FIG. 13A, a dispensing assembly 824 includes a closure shell base 838 and a valve 836 coupled thereto. The base 838 includes a deck 842 of domed, cylindrical, or conical construction. In particular, the domed deck 842 may be incurvately conical. Also, an opening wall 844 of the deck 842 may extend axially and radially inwardly toward a dispensing opening 846. An annular wall 848 extends axially from an undersurface of the deck 842. A radially inwardly extending internal bead 850 may be provided on the annular wall 848.

The valve 836 includes an opening portion 875, a mounting portion 876, and an isolating portion 877. In contrast to the embodiments of FIGS. 1-12, the mounting portion 876 does not establish an axially outward surface of the valve 836. Rather, an axially outward surface of the valve opening portion 875 establishes the axially outward surface of the valve 836. In this embodiment, the mounting portion 876 and the isolating portion 877 form an inverted U-shaped annular portion that is disposed radially outwardly of the opening portion 875.

For example, the mounting portion 876 includes a radially outward annular wall 886 that extends from an axially inward surface 888 of the valve 836. A radially inward annular wall 878 of the opening portion 875 of the valve 836 is flexibly coupled to the mounting portion 876. More specifically, the isolating portion 877 may include a radially intermediate annular wall 892 that may include an axially inward end coupled to the inward annular wall 878. In particular, the axially inward end of the wall 892 may be coupled indirectly to an axially inward end of the inward annular wall 878 by way of a radially inward connecting portion 896, which may be flat as shown or of any other suitable shape. The intermediate annular wall 892 extends axially outwardly and terminates in an axially outward end that may be coupled to the mounting portion 876. More specifically, the axially outward end of the intermediate annular wall 892 may be coupled indirectly to an axially outward end of the annular wall 886 by way of a radially outward connecting portion 898 of the isolating portion 877, which may be curved as shown or may be of any other suitable shape. Accordingly, a radial space 889 may be established between the annular wall 886 and the intermediate annular wall 892, and a radial space 885 may be established between the intermediate annular wall 892 and the inward annular wall 878.

Figure 13B:
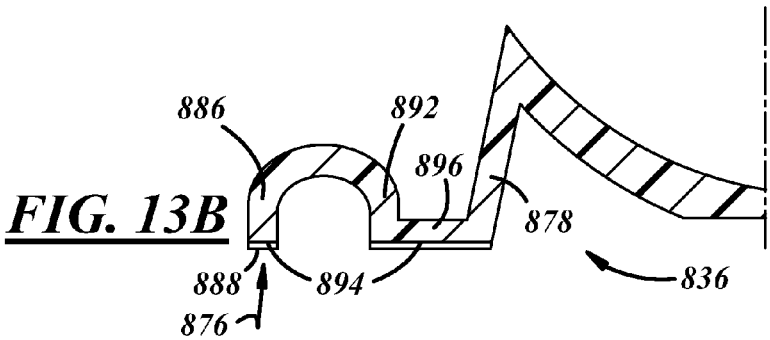
FIG. 13B is a fragmentary sectional view of a dispensing valve of the assembly of FIG. 13A.

Referring to FIG. 13B, the valve 836 is illustrated in a free state, unassembled with respect to a closure shell. The valve 836 additionally may include one or more vacuum breaks 894 in one or more axially inward most surfaces of the valve 836. In this embodiment, the axially inward most surfaces are in the axially inward surface 888 of the mounting portion 876, and in axially inward surfaces of the inward annular wall 878, intermediate annular wall 892, and the inward connection portion 896. From a comparison of FIGS. 13A and 13B, it can be seen that the U-shaped portion of the valve 836 becomes radially compressed between the deck opening wall 844 and the deck annular wall 848 when the valve 836 is assembled to the closure shell base 838.

Figure 14A:
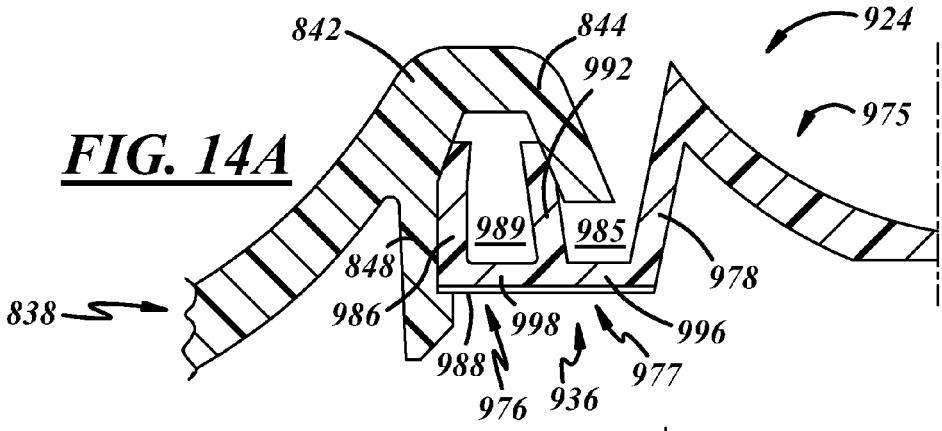
FIG. 14A is a fragmentary sectional view of a dispensing assembly in accordance with a ninth exemplary embodiment.

Referring to FIG. 14A, a dispensing assembly 924 is similar in many respects to the dispensing assembly 824 of FIG. 13A and, for example, may include the closure shell base 838 of FIG. 13A. The dispensing assembly 924 also includes a valve 936 including an opening portion 975, a mounting portion 976, and an isolating portion 977. In this embodiment, however, the mounting portion 976 and the isolating portion 977 form a boxy or block U-shaped annular portion that is disposed radially outwardly of the opening portion 975.

For example, the mounting portion 976 includes a radially outward annular wall 986 that extends from an axially inward surface 988 of the valve 936 and terminates in a free axially outward end. A radially inward annular wall 978 of the opening portion 975 of the valve 936 is flexibly coupled to the mounting portion 976 by the isolating portion 977. More specifically, the inward annular wall 978 is indirectly coupled to the annular wall 986 by way of a radially inward connection portion 996 extending radially outward from the wall 978, a radially intermediate annular wall 992 of the isolating portion 977 connected to the connection portion 996, and a radially outward connection portion 998 of the isolating portion 977 extending radially between the intermediate annular wall 992 and the radially outer annular wall 986 of the mounting portion 976. The connection portions 996, 998 may be flat as shown or may be of any other suitable shape. Axially inward ends of the inward annular wall 978 and intermediate annular wall 992 are directly coupled to opposite ends of the inward connection portion 996. Similarly, axially inward ends of the intermediate annular wall 992 and the annular wall 986 are directly coupled to opposite ends of the outward connection portion. The annular wall 986 and the intermediate annular wall 992 extend axially outwardly and terminate in respective free axially outward ends. Accordingly, a radial space 989 may be established between the annular wall 986 and the intermediate annular wall 992, and a radial space 985 may be established between the intermediate annular wall 992 and the inward annular wall 978.

Figure 14B:
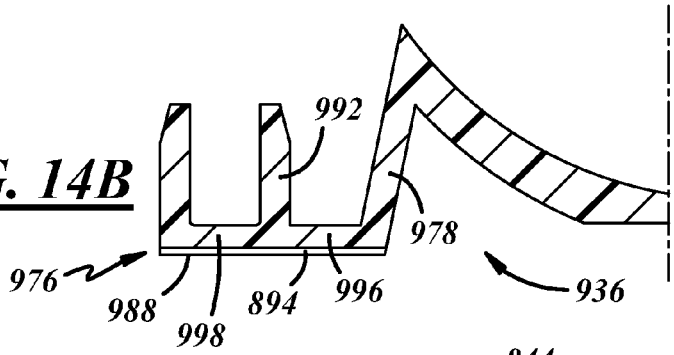
FIG. 14B is a fragmentary sectional view of a dispensing valve of the assembly of FIG. 14A.

Referring to FIG. 14B, the valve 936 is illustrated in a free state, unassembled with respect to a closure shell. The valve 936 additionally may include one or more vacuum breaks 994 in one or more axially inward most surfaces of the valve 936. In this embodiment, the axially inward most surfaces are in the axially inward surface 988 of the mounting portion 976, and in axially inward surfaces of the inward annular wall 978, intermediate annular wall 992, and the connection portions 996, 998. From a comparison of FIGS. 14A and 14B, it can be seen that the block U-shaped portion of the valve 936 becomes radially compressed between the deck opening wall 844 and the deck annular wall 848 when the valve 936 is assembled to the closure shell base 838.

Figure 15A:
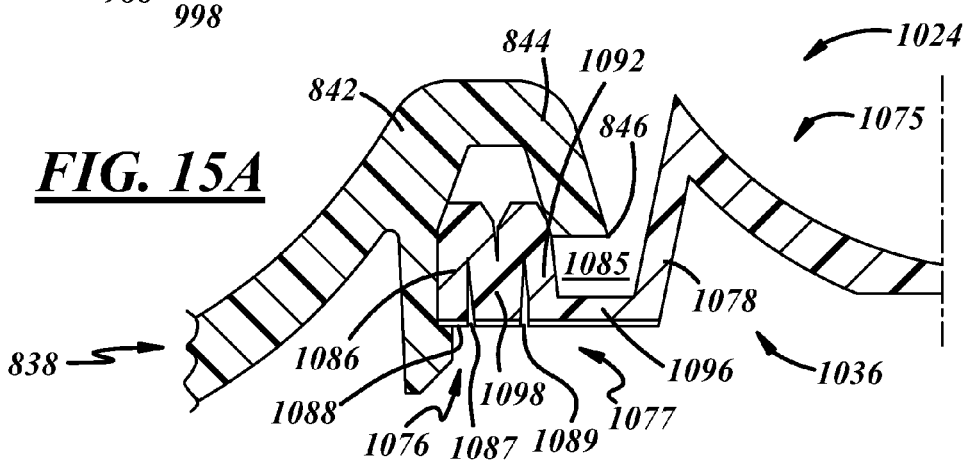
FIG. 15A is a fragmentary sectional view of a dispensing assembly in accordance with a tenth exemplary embodiment.

Referring to FIG. 15A, a dispensing assembly 1024 is similar in many respects to the dispensing assembly 824 of FIG. 13A and, for example, may include the closure shell base 838 of FIG. 13A. The dispensing assembly 1024 also includes a valve 1036 including an opening portion 1075, a mounting portion 1076, and an isolating portion 1077. In this embodiment, however, the mounting portion 1076, and isolating portion 1077 form an M-shaped annular portion that is disposed radially outwardly of the opening portion 1075.

The mounting portion 1076 includes a radially outward annular wall 1086 that extends from an axially inward surface 1088 of the valve 1036 and terminates in an axially outward end. A radially inward annular wall 1078 of the opening portion 1075 of the valve 1036 is flexibly coupled to the mounting portion 1076 by the isolating portion 1077. More specifically, the inward annular wall 1078 is indirectly coupled to the mounting portion 1076 by way of a radially intermediate annular wall 1092 of the isolating portion 1077, and a radially inward connection portion 1096 between the intermediate annular wall 1092 and the inward annular wall 1078. The isolating portion 1077 also includes a radially outward connection portion 1098 between the intermediate annular wall 1092 and the mounting portion 1076. The inward connection portion 1096 may be flat as shown or may be of any other suitable shape, and the outward connection portion 1098 may be V-shaped as shown. Axially inward ends of the inward annular wall 1078 and intermediate annular wall 1092 are directly coupled to opposite ends of the inward connection portion 1096. In contrast, axially outward ends of the intermediate annular wall 1092 and the mounting portion 1076 are directly coupled to corresponding axially outward ends of the outward connection portion 1098. Accordingly, wedge-shaped radial spaces 1087, 1089 may be established between the mounting portion 1076 and the intermediate annular wall 1092, and a radial space 1085 may be established between the intermediate annular wall 1092 and the inward annular wall 1078.

Figure 15B:
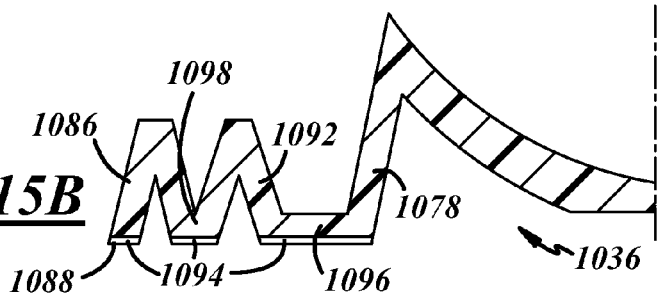
FIG. 15B is a fragmentary sectional view of a dispensing valve of the assembly of FIG. 15A.

Referring to FIG. 15B, the valve 1036 is illustrated in a free state, unassembled with respect to a closure shell. The valve 1036 additionally may include one or more vacuum breaks 1094 in one or more axially inward most surfaces of the valve 1036. In this embodiment, the vacuum breaks 1094 are in the axially inward surface 1088 of the mounting portion 1076, in axially inward surfaces of the inward annular wall 1078, the intermediate annular wall 1092, and the connection portions 1096, 1098. From a comparison of FIGS. 15A and 15B, it can be seen that the M-shaped portion of the valve 1036 becomes radially compressed between the deck opening wall 844 and the deck annular wall 848 when the valve 1036 is assembled to the closure shell base 838.

Figure 16A:
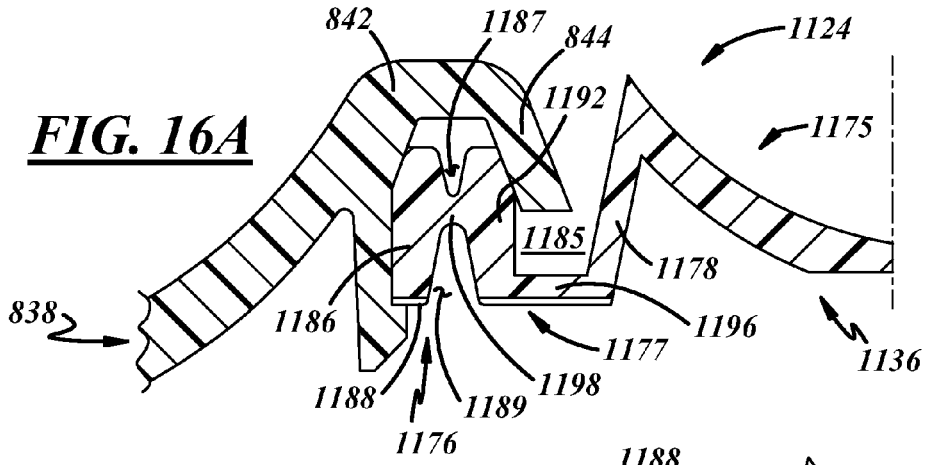
FIG. 16A is a fragmentary sectional view of a dispensing assembly in accordance with an eleventh exemplary embodiment.

Referring to FIG. 16A, a dispensing assembly 1124 is similar in many respects to the dispensing assembly 824 of FIG. 13A and, for example, may include the closure shell base 838 of FIG. 13A. The dispensing assembly 1124 also includes a valve 1136 including an opening portion 1175, a mounting portion 1176, and an isolating portion 1177. In this embodiment, however, the mounting portion 1176, and isolating portion 1177 form an X-shaped annular portion that is disposed radially outwardly of the opening portion 1175.

The mounting portion 1176 includes a radially outward annular wall 1186 that may extend from an axially inward surface 1188 of the valve 1136 and terminates in an axially outward end. A radially inward annular wall 1178 of the opening portion 1175 of the valve 1136 is flexibly coupled to the mounting portion 1176 by the isolating portion 1177. More specifically, the inward annular wall 1178 is indirectly coupled to the mounting portion 1176 by way of a radially intermediate annular wall 1192 of the isolating portion 1177, a radially inward connection portion 1196 between the intermediate annular wall 1192 and the inward annular wall 1178, and a radially outward connection portion 1198 of the isolating portion 1177 extending between the intermediate annular wall 1192 and the mounting portion 1176. The inward connection portion 1196 may be flat as shown or may be of any other suitable shape. Axially inward ends of the inward annular wall 1178 and intermediate annular wall 1192 are directly coupled to opposite ends of the inward connection portion 1196. The outward connection portion 1198 may be transverse and located axially between axially inward and outward ends of the walls 1186, 1192 as shown. Accordingly, axially intermediate portions of the intermediate annular wall 1192 and the mounting portion 1176 are directly coupled to corresponding transverse ends of the outward connection portion 1198. Accordingly, wedge-shaped radial spaces 1187, 1189 may be established between the mounting portion 1176 and the intermediate annular wall 1192, and a radial space 1185 may be established between the intermediate annular wall 1192 and the inward annular wall 1178.

Figure 16B:
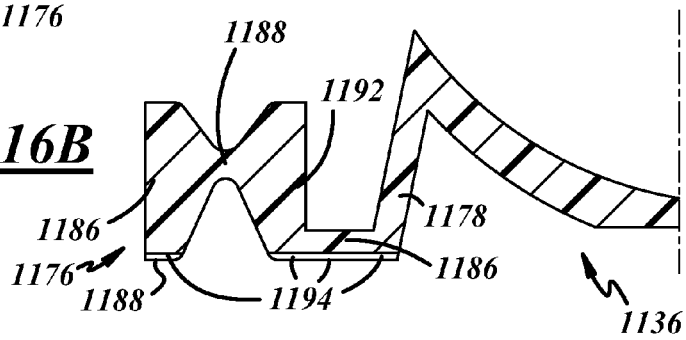
FIG. 16B is a fragmentary sectional view of a dispensing valve of the assembly of FIG. 16A.

Referring to FIG. 16B, the valve 1136 is illustrated in a free state, unassembled with respect to a closure shell. The valve 1136 additionally may include one or more vacuum breaks 1194 in one or more axially inward most surfaces of the valve 1136. In this embodiment, the vacuum breaks 1194 are in the axially inward surface 1188 of the mounting portion 1176, in axially inward surfaces of the inward annular wall 1178, and the intermediate annular wall 1192. From a comparison of FIGS. 16A and 16B, it can be seen that the X-shaped portion of the valve 1136 becomes radially compressed between the deck opening wall 844 and the deck annular wall 848 when the valve 1136 is assembled to the closure shell base 838.

Figure 17A:
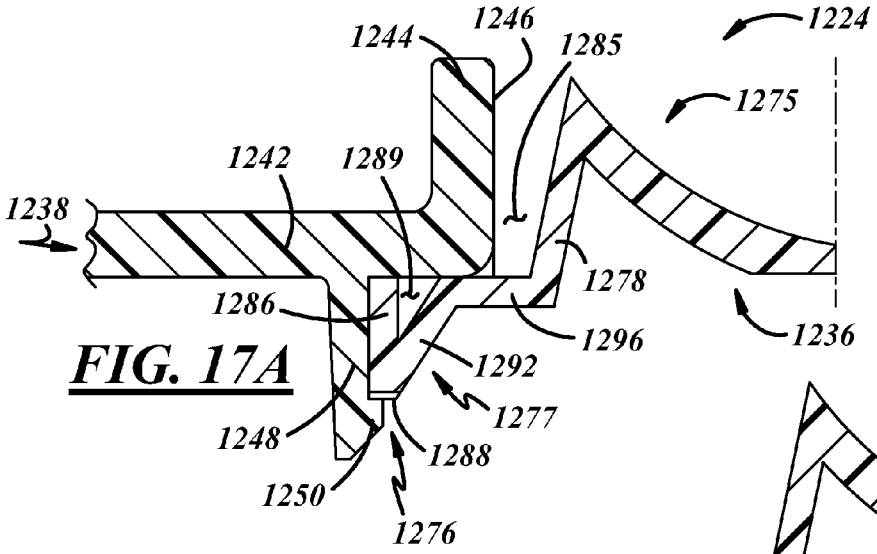
FIG. 17A is a fragmentary sectional view of a dispensing assembly in accordance with a twelfth exemplary embodiment.

Referring to FIG. 17A, a dispensing assembly 1224 includes a closure shell base 1238 and a valve 1236 coupled thereto. The base 1238 includes a deck 1242 of flat construction. Also, an opening wall 1244 of the deck 1242 may extend axially and radially inwardly toward a dispensing opening 1246. An annular wall 1248 extends axially inwardly from an undersurface of the deck 1242. A radially inwardly extending internal bead 1250 may be provided on the annular wall 1248.

The valve 1236 includes an opening portion 1275, a mounting portion 1276, and an isolating portion 1277. In this embodiment, the mounting portion 1276 and isolating portion 1277 form a V-shaped annular portion that is disposed radially outwardly of the opening portion 1275.

The mounting portion 1276 includes a radially outward annular wall 1286 that extends from an axially inward most surface 1288 of the valve 1236. A radially inward annular wall 1278 of the opening portion 1275 of the valve 1236 is flexibly coupled to the mounting portion 1276. More specifically, the isolating portion 1277 may include a radially intermediate annular wall 1292 that may include an axially outward end coupled to the inward annular wall 1278. In particular, the axially outward end of the wall 1292 may be coupled indirectly to an axially inward end of the inward annular wall 1278 by way of a connecting portion 1296, which may be flat as shown or of any other suitable shape. The intermediate annular wall 1292 extends axially inwardly and terminates in an axially inward end that may be coupled to the mounting portion 1276. More specifically, the axially inward end of the intermediate annular wall 1292 may be coupled directly to an axially inward end of the mounting portion 1276. Accordingly, a radial space 1289 may be established between the mounting portion 1276 and the intermediate annular wall 1292.

Figure 17B:
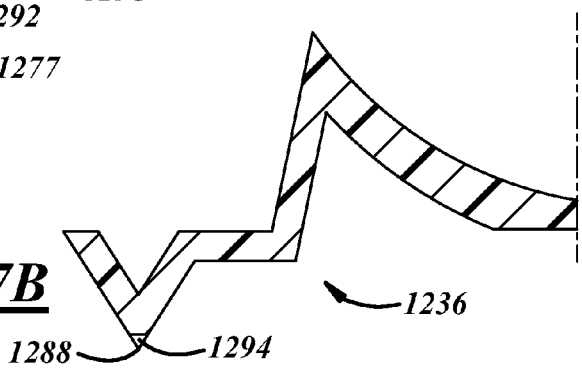
FIG. 17B is a fragmentary sectional view of a dispensing valve of the assembly of FIG. 17A.

Referring to FIG. 17B, the valve 1236 is illustrated in a free state, unassembled with respect to a closure shell. The valve 1236 additionally may include one or more vacuum breaks 1294 in one or more axially inward most surfaces of the valve 1236. In this embodiment, the vacuum break 1294 is in the axially inward surface 1288 of the valve 1236. From a comparison of FIGS. 17A and 17B, it can be seen that the V-shaped portion of the valve 1236 becomes radially compressed radially inwardly of the deck annular wall 1248 when the valve 1236 is assembled to the closure shell base 1238.

Figure 18A:
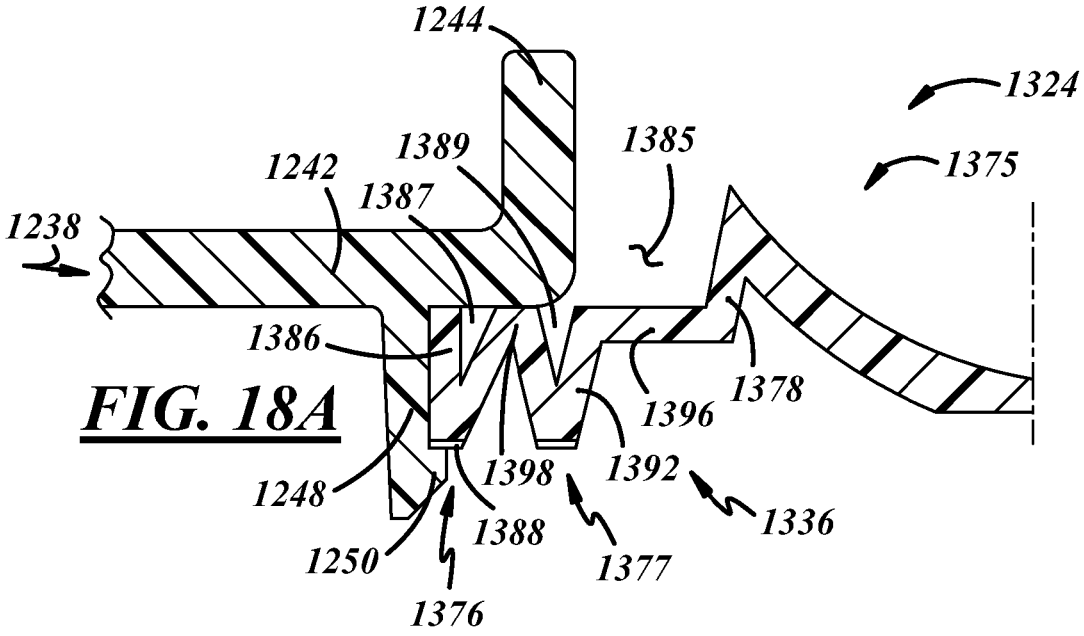
FIG. 18A is a fragmentary sectional view of a dispensing assembly in accordance with a thirteenth exemplary embodiment.

Finally, referring to FIG. 18A, a dispensing assembly 1324 is similar in many respects to the dispensing assembly 1224 of FIG. 17A and, for example, may include the closure shell base 1238 of FIG. 17A. The dispensing assembly 1324 also includes a valve 1336 including an opening portion 1375, a mounting portion 1376, and an isolating portion 1377.

The valve 1336 may combine aspects of the valve 1036 of FIG. 15A and the valve 1236 of FIG. 17A. In this embodiment, however, the mounting portion 1376 and isolating portion 1377 form a W-shaped, or inverted M-shaped, annular portion that is disposed radially outwardly of the opening portion 1375.

The mounting portion 1376 includes a radially outward annular wall 1386 that extends from an axially inward surface 1388 of the valve 1336 and terminates in an axially outward end. A radially inward annular wall 1378 of the opening portion 1375 of the valve 1336 is flexibly coupled to the mounting portion 1376 by the isolating portion 1377. More specifically, the inward annular wall 1378 is indirectly coupled to the mounting portion 1376 by way of a radially intermediate annular wall 1392 of the isolating portion 1377, a radially inward connection portion 1396 between the intermediate annular wall 1392 and the inward annular wall 1378, and a radially outward connection portion 1398 of the isolating portion 1377 between the intermediate annular wall 1392 and the mounting portion 1376. The inward connection portion 1396 may be flat as shown or may be of any other suitable shape, and the outward connection portion 1398 may be of an inverted V-shape as shown. An axially inward end of the inward annular wall 1378 and an axially outer end of the intermediate annular wall 1392 are directly coupled to opposite ends of the inward connection portion 1396. Axially inward ends of the intermediate annular wall 1392 and the mounting portion 1376 are directly coupled to corresponding axially inward ends of the inverted V-shaped outward connection portion 1398. Accordingly, wedge-shaped radial spaces 1387, 1389 may be established between the mounting portion 1376 and the intermediate annular wall 1392, and a radial space 1385 may be established between the intermediate annular wall 1392 and the inward annular wall 1378.

Figure 18B:
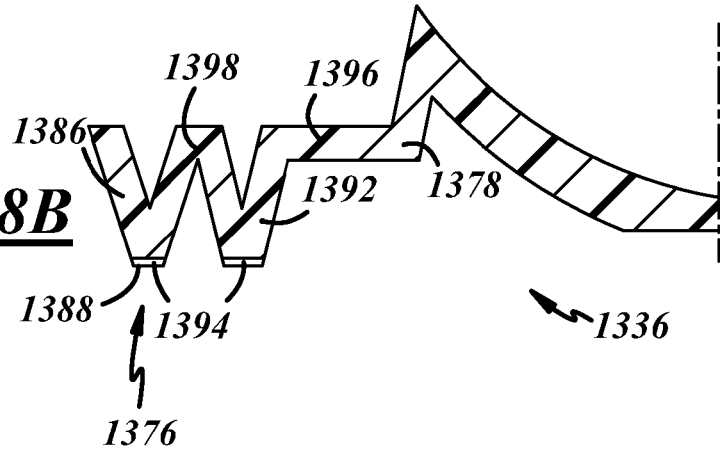
FIG. 18B is a fragmentary sectional view of a dispensing valve of the assembly of FIG. 18A.

Referring to FIG. 18B, the valve 1336 is illustrated in a free state, unassembled with respect to a closure shell. The valve 1336 additionally may include one or more vacuum breaks 1394 in one or more axially inward most surfaces of the valve 1336. In this embodiment, the vacuum breaks 1394 are in the axially inward surface 1388 of the mounting portion 1376, and in axially inward surfaces of the intermediate annular wall 1392 and of the connection portion 1398. From a comparison of FIGS. 18A and 18B, it can be seen that the W-shaped portion of the valve 1336 becomes radially compressed when the valve 1336 is assembled to the closure shell base 1238.

There have thus been disclosed a dispensing valve, dispensing assembly, and package that fully achieve one or more of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

According to another illustrative embodiment of the present disclosure, the dispensing assembly 124 is adapted to mount on the neck finish 30 of the container 22 as suggested in FIGS. 1-6 and as disclosed herein. The dispensing assembly 124 controls discharge of a product stored in the body 28 of the container 22 to surroundings outside of the container through the container mouth established by the neck finish 30 as suggested in FIGS. 1-6 and as disclosed herein. The container mouth extends along the longitudinal axis A of the container 22 as suggested in FIG. 1.

The dispensing assembly 124 illustratively includes the base 138 and the dispensing valve 136 as suggested in FIG. 3. The base 138 is adapted to mount to the neck finish 30 of the container 22 as suggested in FIGS. 1-6 and as discussed herein. The base 138 includes the deck 142, the opening wall 144, the annular wall 148, and an internal bead 150 as suggested in FIG. 3. The opening wall 144 extends inward in the axial direction from the deck 142 toward the body 28 of the container 22 around the dispensing opening 146 as suggested in FIG. 3. The dispensing opening 146 is arranged to receive product discharged from the container 22 through the container mouth in the neck finish 30 as suggested in FIG. 3. The annular wall 148 extends inward in the axial direction along the longitudinal axis A from an undersurface of the deck 144 toward the body 28 of the container 22 as suggested in FIG. 3. The annular bead 150 extends inward in the radial direction from the annular wall as shown in FIG. 3.

The dispensing valve 136 is illustratively coupled to the base 138 to lie in the dispensing opening 146 as suggested in FIG. 3. The dispensing valve 136 includes the opening portion 175, the mounting portion 176, and the isolating portion 177 as suggested in FIGS. 3-6. The opening portion 175 is adapted to allow product to be dispensed through the dispensing valve 136. The mounting portion 176 is coupled to the base 138. The isolating portion 177 extends outward from the longitudinal axis A in the radial direction from the opening portion 175 to the mounting portion 176 as suggested in FIGS. 3-6. The isolating portion 177 flexibly couples the opening portion 175 to the mounting portion 176 so that radial forces on the mounting portion 176 induced by a user squeezing the container 22 causing distortion of the mounting portion 176 are absorbed by the isolating portion 177 rather than being transmitted to the opening portion 175. Thereby distortion of the opening portion 175 is reduced when a user squeezes the container 22 to dispense product in the container 22 as suggested in FIGS. 1-6 and as disclosed herein.

The opening portion 175 includes the annular wall 178 and the web 180 as suggested in FIG. 5. The web 180 is formed to include a first slit 184 as suggested in FIG. 4.

The annular wall 178 of the opening portion 175 extends outward from the longitudinal axis A in the radial direction from the web 180 as suggested in FIG. 5. The annular wall 178 extends inward in the axial direction from the web 180 toward the body 28 of the container 22 as suggested in FIG. 5.

The isolating portion 177 includes an intermediate annular wall 192. The intermediate annular wall 192 extends outward from the longitudinal axis A in the radial direction from the annular wall 178 of the opening portion 175 as suggested in FIGS. 5 and 6. The intermediate annular wall 192 extends outward in the axial direction from the annular wall 178 of the opening portion 175 away from the body 28 of the container 22 as suggested in FIGS. 5 and 6.

The annular wall 178 of the opening portion 175 and the intermediate annular wall 192 of the isolating portion 177 cooperates to establish a wedge-shaped first space 185 as suggested in FIG. 6. The first space 185 is illustratively located between the annular wall 178 of the opening portion 175 and the intermediate annular wall 192 of the isolating portion 177 as suggested in FIG. 6.

A portion of the deck 142 is arranged to extend over the dispensing valve 124 as shown in FIG. 3. The internal bead 150 is arranged to extend under the dispensing valve 124 as shown in FIG. 3. Thus, the deck 142 and the internal bead 150 of the base 138 cooperate to block the dispensing valve 124 from movement outward or inward in the axial direction when the dispensing valve 124 is coupled to the base 138 as shown in FIG. 3.

The isolating portion 177 includes a plurality of ribs 199 as shown in FIGS. 5 and 6. The ribs 199 extend between and interconnect the intermediate annular wall 178 and the mounting portion 176 as shown in FIGS. 5 and 6.

A top surface of the mounting portion 176 is spaced above the opening portion 175. A bottom surface of the mounting portion 176 is spaced below the opening portion 175 as shown in FIGS. 5 and 6.

The annular wall 148 of the base 138 is arranged to surround the mounting portion 176 of the dispensing valve 124 as shown in FIG. 3. Thus, the base 138 blocks the dispensing valve 124 from outward movement in the radial direction when the dispensing valve 124 is coupled to the base 138.

The annular wall 148 of the base 138 surrounds the dispensing opening 146 as suggested in FIG. 3. The annular wall 148 of the base 138 is illustratively coaxial with the dispensing opening 146 as suggested in FIG. 3.

The opening wall 144 extends inward in the radial direction from the deck 140 toward the longitudinal axis A as suggested in FIG. 3. The base includes the internal bead 150 extending inward in the radial direction from the annular wall 148 of the base 138 toward the longitudinal axis A as suggested in FIG. 3.

The deck 142 is illustratively conical as suggested in FIG. 3. The deck 142 has an incurvate shape as suggested in FIG. 3.

The dispensing assembly 124 includes the lid 140 as suggested in FIG. 3. The lid 140 is coupled to the base 138 by a hinge (not shown) as suggested in FIG. 3 and as disclosed herein. The lid 140 includes the base wall 164, the annular bead 172, and the plug 174 as suggested in FIG. 3. The annular bead 172 extends inward in the axial direction from the base wall 164 toward the body 28 of the container 22 as suggested in FIG. 3. The plug extends inward in the axial direction from the base wall 164 toward the body 28 of the container 22 and is illustratively located radially within the annular bead 172 as suggested in FIG. 3.

The mounting portion 176 includes the annular wall 186 as suggested in FIGS. 5 and 6. The annular wall 186 extends outward in the radial direction from the intermediate annular wall 192 of the isolating portion 177 away from the longitudinal axis A as suggested in FIGS. 5 and 6. The annular wall 186 also extends inward in the axial direction from the intermediate annular wall 192 of the isolating portion 177 toward the body 28 of the container 22 as suggested in FIGS. 5 and 6.

The annular wall 186 of the mounting portion 176 and the intermediate annular wall 192 of the isolating portion 177 cooperates to form a second space 189 as suggested in FIGS. 5 and 6. The second space 189 is located between the annular wall 186 of the mounting portion 176 and the intermediate annular wall 192 of the isolating portion 177 as suggested in FIG. 6. The plurality of ribs 199 extends into the second space 189 between the annular wall 186 of the mounting portion 176 and the intermediate annular wall 192 of the isolating portion 177 as suggested in FIGS. 5 and 6. The second space 189 is wedge-shaped as shown in FIGS. 5 and 6. Each of the plurality of ribs 199 is wedge-shaped to fill a corresponding portion of the second space 189 as shown in FIG. 5.

The annular wall 186 of the mounting portion 176 is formed to include the axially inward surface 188, the cylindrical outer surface 183, and the step 181 as suggested in FIGS. 5 and 6. The outer surface 183 is adjacent to the axially inward surface 188 as suggested in FIGS. 5 and 6. The step 181 is located between the axially inward surface 188 and the cylindrical outer surface 183 as suggested in FIGS. 5 and 6. The step 181 is configured to receive the internal bead 150 extending inward in the radial direction from the annular wall 148 of the base 138 toward the longitudinal axis A so that the dispensing valve 136 is retained to the base 138 as suggested in FIG. 3.

The invention claimed is:

1. A dispensing valve comprising a resiliently flexible mounting portion;

a resiliently flexible opening portion disposed radially inwardly of said mounting portion; and a resiliently flexible isolating portion disposed radially between and coupled to said mounting and opening portions, the isolating portion including an intermediate annular wall and a plurality of ribs, wherein the intermediate annular wall extends outwardly in a radial direction and outwardly in an axial direction to form a first radial space between said opening and isolating portions, the intermediate annular wall is spaced radially inwardly of said mounting portion to form a second radial space between said mounting portion and said intermediate annular wall, and the plurality of ribs extend through the second radial space from the intermediate annular wall to the mounting portion to connect the intermediate annular wall and the mounting portion.

2. The valve set forth in claim 1 wherein said opening and isolating portions form a V-shaped portion radially outward of a web of said opening portion.

3. The valve set forth in claim 2 wherein said mounting portion and said isolating portion form an inverted V-shaped portion radially outward of said opening portion.

4. The valve set forth in claim 1 wherein said mounting portion and said isolating portion form an inverted V-shaped portion radially outward of said opening portion.

5. The valve set forth in claim 1 wherein said mounting portion extends to an axially outward end in an axially outward and radially inward direction, and said isolating portion extends from said axially outward end in an axially and radially inward direction to an axially inward end, and said opening portion includes a radially inward annular wall extending from said axially inward end in an axially outward and radially inward direction to a web of said opening portion.

6. The valve set forth in claim 5 wherein said mounting portion includes an axially inward most surface of said valve.

7. The valve set forth in claim 5 wherein said radially inward annular wall and said isolating portion include an inward most surface of said valve.

8. The valve set forth in claim 1 wherein said mounting portion extends radially outwardly from an axial outward end of said isolating portion.

9. The valve set forth in claim 8 wherein said mounting portion extends axially outwardly with respect to said axial outward end of said isolating portion.

10. The valve set forth in claim 9 wherein said mounting portion includes spaced apart annular rings.

11. The valve set forth in claim 1 wherein a connecting portion extends transversely between axially inward ends of said opening and isolating portions to form said radially inward space.

12. The valve set forth in claim 11, wherein said opening and isolating portions form a U-shaped portion radially outward of a web of said opening portion.

13. The valve set forth in claim 11, wherein said mounting portion and said isolating portion form an inverted U-shaped portion radially outward of said opening portion.

14. The valve set forth in claim 11, wherein said mounting portion and said isolating portion form a block U-shaped portion radially outward of said opening portion.

15. The valve set forth in claim 11, wherein said mounting portion and said isolating portion form an M-shaped portion radially outward of said opening portion.

16. The valve set forth in claim 11, wherein said mounting portion and said isolating portion form at least one of an X-shaped portion or a W-shaped portion radially outward of said opening portion.

17. The valve set forth in claim 1 wherein a connecting portion extends transversely between an axially inward end of a radially inward annular wall of said opening portion and an axially outward end of said isolating portion to form said radially inward space.

18. The valve set forth in claim 17 wherein said mounting portion and said isolating portion form at least one of a V-shaped portion or a W-shaped portion radially outward of said opening portion.

19. The valve set forth in claim 1 wherein said mounting portion includes a radially outer wall having a cylindrical mounting surface and having a conical outer profile extending axially outwardly from said cylindrical surface.

20. The valve set forth in claim 19 wherein said outer wall includes an axially inward surface, and a step between said axially inward and cylindrical surfaces.

21. The dispensing valve set forth in claim 1, wherein said mounting portion includes a radially outward annular wall.

22. The dispensing valve set forth in claim 21, wherein said radially outward annular wall is cantilevered from said radially intermediate annular wall.

23. A dispensing valve comprising a resiliently flexible mounting portion including a radially outward annular wall;

a resiliently flexible opening portion disposed radially inwardly of said mounting portion, and including a radially inward annular wall, a web extending radially inwardly of said radially inward annular wall, and at least one slit in said web; and a resiliently flexible isolating portion disposed radially between and coupled to said mounting and opening portions, and extending both radially outwardly and axially to form a first radial space between said isolating portion and said radially inward annular wall of said opening portion, and spaced radially inwardly of said radially outward annular wall of said mounting portion to form a second radial space between said isolating portion and said radially outward annular wall of said mounting portion, wherein said isolating portion includes at least a radially intermediate annular wall, said radially outward annular wall is cantilevered from said radially intermediate annular wall, and a plurality of ribs that extend from the radially intermediate annular wall to the radially outward annular wall and interconnect the resiliently flexible isolating portion and the resiliently flexible mounting portion.

24. The dispensing valve set forth in claim 23, wherein the at least one slit establishes at least two petals, and wherein a flexible coupling is provided by the isolating portion between the opening portion and the mounting portion to absorb forces so that the petals will properly seat to one another to seal the valve closed.

25. A dispensing assembly adapted to mount on a neck finish of a container to control discharge of a product stored in a body of the container to surroundings outside of the container through a container mouth established by the neck finish along a longitudinal axis of the container, the dispensing assembly comprising a base adapted to mount to the neck finish of the container, the base including a deck, an opening wall extending inward in an axial direction from the deck toward the body of the container around a dispensing opening arranged to receive product discharged from the container through the neck finish, an annular wall extending inward in the axial direction along the longitudinal axis from an undersurface of the deck toward the body of the container, and a dispensing valve coupled to the base to lie in the dispensing opening, the dispensing valve including an opening portion adapted to allow product to be dispensed through the dispensing valve, a mounting portion coupled to the base, and an isolating portion extending outward from the longitudinal axis in a radial direction from the opening portion to the mounting portion to provide means for flexibly coupling the opening portion to the mounting portion so that radial forces on the mounting portion induced by a user squeezing the container causing distortion of the mounting portion are absorbed by the isolating portion rather than being transmitted to the opening portion thereby reducing distortion of the opening portion when a user squeezes the container to dispense product in the container, wherein the opening portion includes an annular wall and a web formed to include a first slit, the annular wall of the opening portion extends outward from the longitudinal axis in the radial direction from the web and extends inward in the axial direction from the web toward the body of the container, the isolating portion includes an intermediate annular wall and a plurality of ribs extending between and interconnecting the intermediate annular wall and the mounting portion, the intermediate annular wall extends outward from the longitudinal axis in the radial direction from the annular wall of the opening portion and extends outward in the axial direction from the annular wall of the opening portion away from the body of the container, the annular wall of the opening portion and the intermediate annular wall of the isolating portion cooperate to establish a wedge-shaped first space between the annular wall of the opening portion and the intermediate annular wall of the isolating portion.

26. The dispensing assembly of claim 25, wherein the annular wall of the base surrounds the dispensing opening.

27. The dispensing assembly of claim 26, wherein the annular wall of the base is coaxial with the dispensing opening.

28. The dispensing assembly of claim 25, wherein the opening wall extends inward in the radial direction from the deck toward the longitudinal axis.

29. The dispensing assembly of claim 25, wherein the deck is conical.

30. The dispensing assembly of claim 29, wherein the deck has an incurvate shape.

31. The dispensing assembly of claim 25, further comprising a lid coupled to the base by a hinge.

32. The dispensing assembly of claim 31, wherein the lid includes a base wall, an annular bead extending inward in the axial direction from the base wall toward the body of the container, and a plug extending inward in the axial direction from the base wall toward the body of the container and located radially within the annular bead.

33. The dispensing assembly of claim 25, wherein the mounting portion includes an annular wall extending outward in the radial direction from the intermediate annular wall of the isolating portion away from the longitudinal axis and extending inward in the axial direction from the intermediate annular wall of the isolating portion toward the body of the container.

34. The dispensing assembly of claim 33, wherein the annular wall of the mounting portion and the intermediate annular wall of the isolating portion cooperate to form a second space between the annular wall of the mounting portion and the intermediate annular wall of the isolating portion.

35. The dispensing assembly of claim 34, wherein the plurality of ribs extend into the second space between the annular wall of the mounting portion and the intermediate annular wall of the isolating portion.

36. The dispensing assembly of claim 35, wherein the second space is wedge-shaped.

37. The dispensing assembly of claim 33, wherein the annular wall of the mounting portion is formed to include an axially inward surface, a cylindrical outer surface adjacent to the axially inward surface, and a step located between the axially inward surface and the cylindrical outer surface.

38. The dispensing assembly of claim 37, wherein the step is configured to receive an internal bead extending inward in the radial direction from the annular wall of the base toward the longitudinal axis so that the dispensing valve is retained to the base.

39. The dispensing assembly of claim 25, wherein the web of the opening portion extends inward in the radial direction from the annular wall of the opening portion toward the longitudinal axis and extends inward toward the body of the container in the axial direction from the annular wall of the opening portion.

40. The dispensing assembly of claim 39, wherein the web is concave.

41. The dispensing assembly of claim 40, wherein the web is formed to include a second slit crossed with the first slit.

42. A dispensing assembly adapted to mount on a neck finish of a container to control discharge of a product stored in a body of the container to surroundings outside of the container through a container mouth established by the neck finish along a longitudinal axis of the container, the dispensing assembly comprising a base adapted to mount to the neck finish of the container, the base including a deck, an opening wall extending inward in an axial direction from the deck toward the body of the container around a dispensing opening arranged to receive product discharged from the container through the neck finish, an annular wall extending inward in the axial direction along the longitudinal axis from an undersurface of the deck toward the body of the container, and an internal bead extending inward in the radial direction from the annular wall, and a dispensing valve coupled to the base to lie in the dispensing opening, the dispensing valve including an opening portion adapted to allow product to be dispensed through the dispensing valve, a mounting portion coupled to the base, and an isolating portion extending outward from the longitudinal axis in a radial direction from the opening portion to the mounting portion to flexibly couple the opening portion to the mounting portion so that radial forces on the mounting portion induced by a user squeezing the container causing distortion of the mounting portion are absorbed by the isolating portion rather than being transmitted to the opening portion thereby reducing distortion of the opening portion when a user squeezes the container to dispense product in the container, wherein the opening portion includes an annular wall and a web formed to include a first slit, the annular wall of the opening portion extends outward from the longitudinal axis in the radial direction from the web and extends inward in the axial direction from the web toward the body of the container, the isolating portion includes an intermediate annular wall that extends outward from the longitudinal axis in the radial direction from the annular wall of the opening portion and extends outward in the axial direction from the annular wall of the opening portion away from the body of the container, the annular wall of the opening portion and the intermediate annular wall of the isolating portion cooperate to establish a wedge-shaped first space between the annular wall of the opening portion and the intermediate annular wall of the isolating portion, and a portion of the deck is arranged to extend over the dispensing valve and the internal bead is arranged to extend under the dispensing valve to block the dispensing valve from movement outward and in ward in the axial direction when the dispensing valve is coupled to the base.

43. The dispensing assembly of claim 42, wherein the isolating portion includes a plurality of ribs that extend between and interconnect the intermediate annular wall and the mounting portion.

44. The dispensing assembly of claim 42, wherein a top surface of the mounting portion is spaced above the opening portion and a bottom surface of the mounting portion is spaced below the opening portion.

45. The dispensing assembly of claim 42, wherein the annular wall of the base is arranged to surround the mounting portion of the dispensing valve to block the dispensing valve from outward movement in the radial direction when the dispensing valve is coupled to the base.

46. The dispensing assembly of claim 42, wherein the annular wall of the base surrounds the dispensing opening.

47. The dispensing assembly of claim 46, wherein the annular wall of the base is coaxial with the dispensing opening.

48. The dispensing assembly of claim 42, wherein the opening wall extends inward in the radial direction from the deck toward the longitudinal axis.

49. The dispensing assembly of claim 25, wherein the deck is conical.

50. The dispensing assembly of claim 25, wherein the deck has an incurvate shape.

51. The dispensing assembly of claim 42, further comprising a lid coupled to the base by a hinge.

52. The dispensing assembly of claim 51, wherein the lid includes a base wall, an annular bead extending inward in the axial direction from the base wall toward the body of the container, and a plug extending inward in the axial direction from the base wall toward the body of the container and located radially within the annular bead.

53. The dispensing assembly of claim 42, wherein the mounting portion includes an annular wall extending outward in the radial direction from the intermediate annular wall of the isolating portion away from the longitudinal axis and extending inward in the axial direction from the intermediate annular wall of the isolating portion toward the body of the container.

54. The dispensing assembly of claim 53, wherein the annular wall of the mounting portion and the intermediate annular wall of the isolating portion cooperate to form a second space between the annular wall of the mounting portion and the intermediate annular wall of the isolating portion.

55. The dispensing assembly of claim 54, wherein the plurality of ribs extend into the second space between the annular wall of the mounting portion and the intermediate annular wall of the isolating portion.

56. The dispensing assembly of claim 55, wherein the second space is wedge-shaped and each of the plurality of ribs is wedge-shaped to fill a corresponding portion of the second space.

57. The dispensing assembly of claim 53, wherein the annular wall of the mounting portion is formed to include an axially inward surface, a cylindrical outer surface adjacent to the axially inward surface, and a step located between the axially inward surface and the cylindrical outer surface.

58. The dispensing assembly of claim 57, wherein the step is configured to receive the internal bead extending inward in the radial direction from the annular wall of the base toward the longitudinal axis so that the dispensing valve is retained to the base.

* * * * *